US005455550A

United States Patent [19]

von Alten et al.

[11] Patent Number: 5,455,550

[45] Date of Patent: Oct. 3, 1995

[54] DUAL GAP ELECTROMAGNETIC ACTUATOR HAVING A BYPASSING POLE GAP AND A VARIABLE POLE GAP

[75] Inventors: Thomas W. von Alten, Boise; Steven M. Johnson, Eagle; Michael O. King, Boise, all of Id.

[73] Assignee: Hewlett-Packard Company, Palo Alto, Calif.

[21] Appl. No.: 236,948

[22] Filed: May 2, 1994

[51] Int. Cl.[6] ..... H01H 51/22

[52] U.S. Cl. ..... 335/78; 335/80

[58] Field of Search ..... 335/78–86, 128, 335/124, 131, 132

[56] References Cited

U.S. PATENT DOCUMENTS 2,241,838 5/1941 Wilson ..... 335/78

5,317,294 5/1994 Vielot ..... 335/80

*Primary Examiner*—Lincoln Donovan

*Attorney, Agent, or Firm*—E. F. Oberheim

[57] ABSTRACT

An electromagnetic actuator has a U-shaped yoke with substantially parallel legs and a keeper which is pivotally mounted for angular movement about an axis located outside of the yoke to move between two angular positions bridging the yoke legs. The proximal end of the keeper adjacent the pivot has a side face which confronts the end of one pole leg forming a variable length gap called the proximal gap, and, the distal end of the keeper has an end face which confronts a side pole face of the other leg of the yoke forming a gap, called a distal gap, the length of which changes very little between and in the two angular positions of the keeper. The torque constant over the displacement range between the two angular positions of the keeper only slightly changes. The design permits keeper movement through a large angle while minimizing operational current requirements.

12 Claims, 3 Drawing Sheets

DUAL GAP ELECTROMAGNETIC ACTUATOR HAVING A BYPASSING POLE GAP AND A VARIABLE POLE GAP

RELATED APPLICATION

A copending application, Ser. No. 08/236,947, of Thomas W. von Alten entitled: Recording/Reproducing Device Having A Bypassing Pole Electromagnetic Actuator Latch Of Low Power Requirement, filed on the same date as this application and assigned to the assignee of this invention, contains subject matter which is disclosed in this application.

TECHNICAL FIELD

This invention relates generally to an electromagnetic actuator having a yoke and a pivoted keeper in which provision is made for minimizing the variation in magnetic circuit reluctance and the variation in keeper torque constant over an enlarged angular range of keeper movement.

BACKGROUND OF THE INVENTION

A typical prior art configuration of an electromagnetically operated latch is seen in FIG. 1. Here, an electromagnet has a U-shaped yoke or core structure 1 supported upon a frame 2. The yoke mounts a coil 3 on one leg 1*a*. A latch lever 4, having a pole end 4*a* and a latch end 4*b*, mounts a keeper 4*c* on the pole end 4*a* for angular movement about the axis of a pivot 5 on the frame 2. The axis of the pivot is centered in a position above the end of the other leg 1*b* of the yoke 1, defining a magnetic gap 6. The lever 4 is biased by a spring 7 to a first position, the latch position, which is the position shown in FIG. 1. The keeper 4*c* on the lever 4 defines a variable length magnetic gap 8 with the pole tip 1*al* on the end of the yoke leg 1*a* on which the coil 3 is wound. When the coil 3 is energized, the force of flux coupling at the magnetic gap 8 rotates the lever 4 clockwise against the force of the spring 7. Flux coupling with the keeper at the magnetic gap 6, being centered on the axis of the pivot 5, produces no useful torque. In the latched position of the lever 4, the magnetic gap 8 is large and the gap reluctance is high, requiring a high coil current to move the lever 4 from latched position, which is undesirable. Keeping the gap 8 small, limits angular movement of the lever 4, necessitating a long length of the latch end 4*b* of the lever 4. Making the latch end 4*b* of the latch lever 4 longer than the pole end 4*a* can provide adequate displacement of the latch hook 4*d* with limited angular displacement of the latch lever 4 for latching and releasing purposes.

Having the magnetic gap 8 close to the pivot 5 of the lever 4, minimizes the dimension of the magnetic gap 8 in the latched position of the lever 4, but the electromagnetic moment arm 4*a* being shod requires higher flux density in the gap 8 to achieve the required torque for operating the lever. The primary disadvantage of this design is that it is difficult to scale the electromagnetic latch to a smaller device such as a smaller form factor disk drive. If the distance of travel of the latch hook 4*d* is fixed, an even greater difference between the pole end length and the latch hook end length is required if the overall size is to be reduced.

A design of an electromagnet is needed in which the variation of the reluctance of the magnetic circuit between latched and unlatched angular positions of the latching lever 4 is minimal to permit increased angular displacement of the latch lever 4 while minimizing operating current requirements.

It is also evident that an electromagnetic actuator latch design is needed which utilizes a minimum of electric power to move the latch lever to actuator released position and to maintain the latch lever 4 in that position, in continuous use of the disk drive.

SUMMARY OF THE INVENTION

A bypassing pole electromagnetic actuator, according to the presently known best mode for practicing this invention, comprises a steel circuit or yoke of magnetic material having a short leg and a long leg. The long leg has a side pole face adjacent its end portion facing in the direction of the shod leg. A flux plate or keeper of magnetic material is mounted to a lever which is pivoted for angular movement at a pivot location adjacent the end of the shod leg outside of the yoke structure. The keeper which has a proximal end adjacent the pivot defines a variable length gap, called the proximal gap, with the pole face at the end of the short leg and, at its distal end, defines a bypassing pole gap, called the distal gap, between the end face at its distal end and the side pole face of the long leg adjacent the end of the long leg. This places the proximal gap and the distal gap at different distances in the same direction from the axis of the pivot, the proximal gap being at the shorter of the different distances from the axis of the pivot.

A coil on the yoke structure, when energized, produces magnetic flux in the yoke structure and magnetic fields linking the keeper across the magnetic gaps. The distal gap is small and remains small during angular displacement of the keeper and, hence, is of low reluctance. The small change in reluctance at the distal gap at the long yoke leg, due to the overlap of the side pole face and the keeper end face, between the extremes of angular displacement of the keeper, also contributes to minimizing the variation of the magnetic torque constant over a larger angular displacement range of the keeper for a given electrical input, than is obtainable with an electromagnetic actuator of the geometry of FIG. 1, for example.

A spring biases the keeper angularly about the axis of the pivot to a spring biased position angularly displaced from the yoke. In this position, the length of the proximal gap at the short leg is slightly increased, but the gap length at the distal gap at the end of the long leg is practically unchanged, the end face of the keeper, being only laterally displaced with respect to the side pole face adjacent the end of the long leg, hence, the term bypassing pole face. Thus, the magnetic reluctance at the distal pole face changes very little over the angular displacement range of the keeper. The design, however, with the keeper in spring biased position, when the coil is energized, provides a component of force on the keeper, due to flux coupling at the distal gap, which is summed with that at the proximal gap in producing torque about the keeper axis to minimize the current required for initiating keeper movement from spring biased position.

BRIEF DESCRIPTION OF THE DRAWINGS

This invention will be better understood by reference to the following specification considered in junction with the accompanying drawings, in which.

DESCRIPTION OF THE PREFERRED EMBODIMENT

Figure 3:
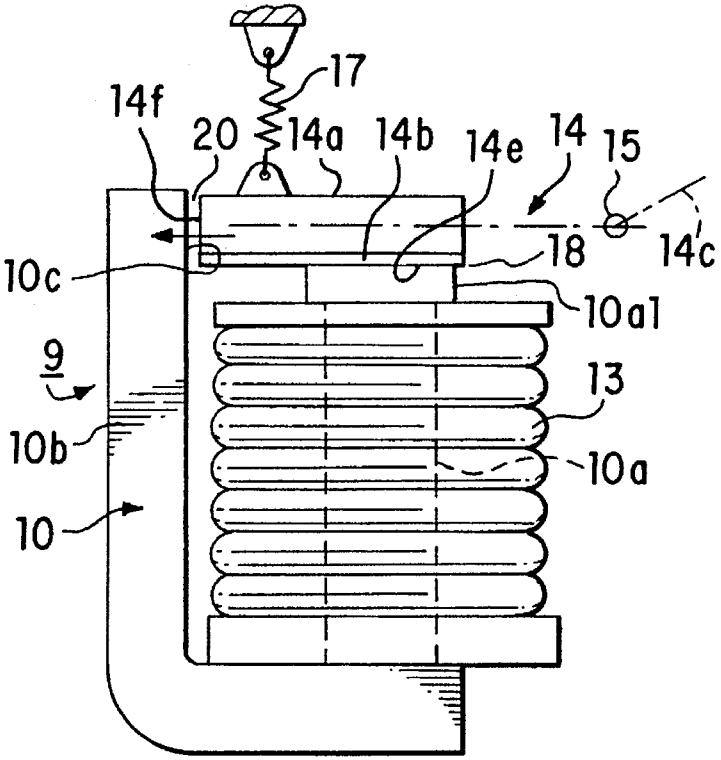
FIGS. 2 and 3 are elevational views of an electromagnetic actuator embodying the principles of this invention, illustrating the lever in respective angular positions occupied when the electromagnetic actuator is de-energized and energized, respectively.
Figure 2:
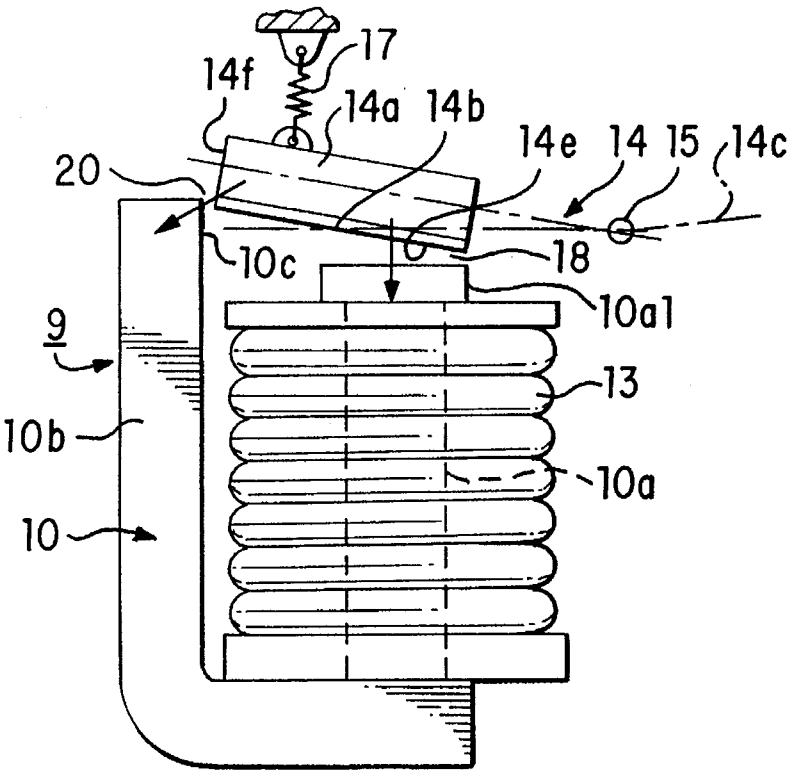

The electromagnetic device seen in FIGS. 2 and 3, represents the presently known best mode for practicing this invention. An electromagnetic actuator 9 has a U-shaped yoke or core structure 10 and an .angularly movable lever 14 comprising a pole end 14*a* and a functional end 14*b*, the latter for performing some useful work function. The lever 14 is preferably of plastic or other non-magnetic material. A keeper 14*b* is mounted to the bottom face of the pole end 14*a* of the lever 14.

The U-shaped yoke 10 has a short leg 10*a* and a long leg 10*b* and mounts a coil 13 on its short leg 10*a*. The lever 14 is mounted for rotation about a pivot 15 having an axis in a position displaced to the right of the yoke 10, as viewed. The keeper 14*b* of the lever 14 has a side face 14*e* at its proximal end defining a variable length short leg gap 18, which is called the proximal gap, with the pole face 10*a*1 at the end of the short leg 10*a*, and, has an end face 14*f* at its distal end, which confronts a side pole face 10*c* on the long pole leg 10*b* adjacent its upper end, defining a long leg gap 20 which is called the distal gap.

The lever 14 is biased by a spring 17, here functionally depicted as a tension spring spring, to a spring biased angular position which it occupies when the electromagnetic actuator 9 is de-energized, as in FIG. 2, and is electromagnetically biased to an angular position which it occupies when the electromagnetic actuator 9 is energized, as in FIG. 3.

This construction minimizes the variation in yoke reluctance at the magnetic gaps 18 and 20 between and in angular position extremes of the keeper 14*b*.

When the electromagnetic actuator 9 is energized and the keeper 14*b* is in its magnetically biased angular position, FIG. 3, the end face 14*f* of the keeper 14*b* overlaps the side pole face 10*c* of the long leg 10*b* of the yoke structure 10, at the distal magnetic gap 20. When the coil 13 of the electromagnetic actuator 9 is de-energized and the keeper 14*b* is in its spring biased angular position, the end face 14*f* of the keeper 14*c* is adjacent the upper end of the side pole face 10*c* of the long leg 10*b* of the yoke structure 10. During the angular displacement of the keeper 14*b*, between its extremes of angular movement, the end face 14*f* of the distal end of the keeper 14*b* sweeps past the side pole face 10*c* adjacent the upper end of the long leg 10*b*. With this construction, the length of the distal gap 20 is very small and remains small throughout the angular displacement range of the keeper 14*c*. The length of the distal gap being small, its reluctance is low. The length of the distal gap 20 changing very little between the extremes of keeper angular movement, its reluctance variation is small.

When the coil 13 is energized, the magnetic fields indicated by the arrows in the magnetic gaps 18 and 20 link the keeper 14*b*. The forces acting at the proximal and distal magnetic gaps 18 and 20, with the keeper 14*b* in the spring biased angular position, as seen in FIG. 2, have components which are summed in the lever 14 and the resulting torques act in the same direction about the axis of the pivot 15, providing initial torque, in a relatively low reluctance magnetic circuit, when the coil 13 is first energized, of a magnitude substantially the same as the torque in other angular positions of the keeper 14*b*. This minimizes operational power requirements in initiating electromagnetic actuation of the armature lever 14. While the component of force at the distal gap 20 decreases as the keeper 14*b* moves to its magnetically biased position, the force at the proximal gap increases so that the torque constant changes very little. As noted above, the bypassing pole construction at the distal gap 20 permits reduction of the size or length of the distal gap to reduce the reluctance. Since the length of the distal gap is substantially constant over the range of keeper movement its reluctance over the stroke between the angular extremes of the keeper 14*b*, is substantially constant. Closure of the variable magnetic gap 18 significantly reduces the magnetic circuit reluctance, allowing a much smaller current to hold the keeper 14*b*. Thus, a smaller electromagnetic actuator a is possible for a given application.

In the configuration seen in FIGS. 2 and 3, the pole face 10*al* at the upper end of the short leg 10*a* at the proximal gap 18 may be used as a limit stop for the keeper 14*b* when the coil 13 is energized. The distal gap 20 provides high enough reluctance in this situation so that steel on steel contact at the proximal gap 18 may be made without sticking when the coil 13 is de-energized.

While the electromagnetic actuator 9 may be employed in controlling an element or a function of any physical system where the simple displacement of a lever 14 is useful as the controlling element, the electromagnetic actuator 9 is particularly useful in latching and unlatching an actuator, linear or rotary, in a hard disk drive. Such an application is seen in FIGS. 4 and 5.

Figure 4:
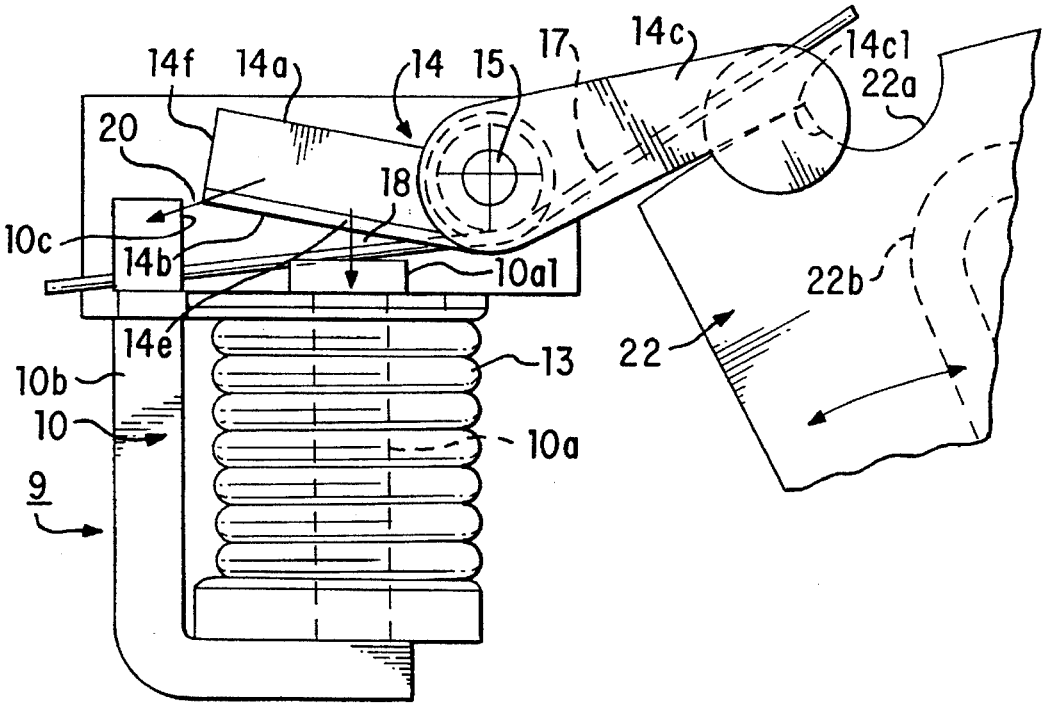
FIGS. 4 and 5 depict the electromagnetic actuator of this invention in an embodiment applicable as an actuator latch in a rotary actuator type of disk drive and showing the electromagnetically actuated latch in latched and unlatched positions, respectively.
Figure 5:
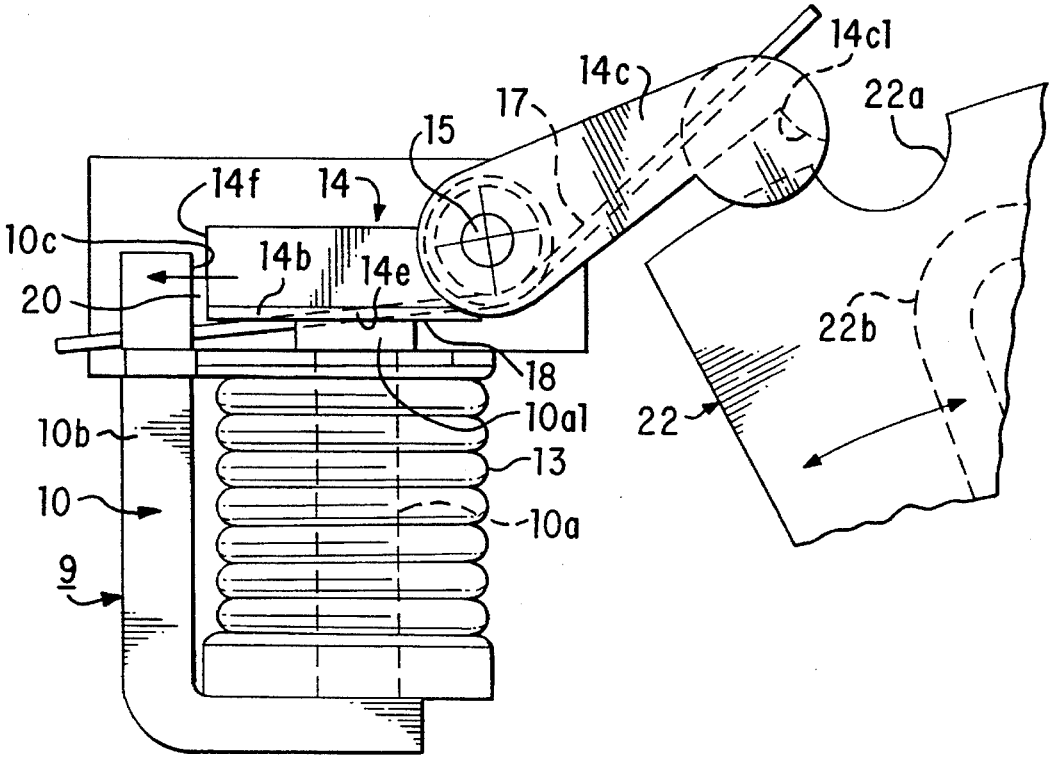

FIGS. 4 and 5 provide details of an actuator latch arm 14*c* on the lever 14 for its application in latching an actuator motor armature 22 of a conventional axial gap rotary actuator motor in a disk drive. The axis about which the actuator motor armature 22 is pivoted is not seen in either of FIGS. 4 or 5 because of the large scale of the drawings. The double ended arcuate arrow, however, indicates the bi-directional, arcuate angular movement of this actuator motor armature. Part of the actuator motor winding 22*b*, which is mounted to the actuator motor armature 22, is seen in both FIGS. 4 and 5.

The actuator motor armature 22 is provided with an arcuate notch 22*a* in its outer peripheral edge. The latch arm 14*c* provided with a latch member 14*c*1 at its distal end which fits into and engages the left edge of the arcuate notch 22*a*.

In applications in disk drives, when the disk drive is not in use, the magnetic heads are moved to a landing zone on the surface of the disks, in which position the heads are removed from the data zone of the disk. When the disk drive is de-energized, and the disk spins down, the magnetic heads, which normally ride on the air bearing at the surface of the disk, land upon the disk surface in the landing zone and rest upon this surface after the disk has stopped. When the disk has stopped, the coil 13 of the electromagnetic actuator is de-energized. As seen in FIG. 4, the spring 17 then biases the lever 14 in a clockwise direction rotating the latch arm 14*c* clockwise so that the latch member 14*c*1 engages the arcuate notch 22*a*. This is a secure engagement which prevents motion of the actuator armature 22 in the presence of shock forces.

When the disk drive is to be operated, power is applied to the disk assembly. When the disk assembly is spinning at operating speed, the magnetic heads on the rotary actuator fly on the air bearing moving with the surface of the disk in the landing zone and thus are out of contact with the disk surface. At this point, as part of the start up cycle, the coil 13 of the electromagnetic actuator is energized which rotates the lever 14 in a counter-clockwise direction angularly displacing the latch arm 14*c* and the latch member 14*c*1 to a position in which the latch member 14*c*1 clears the peripheral edge of the actuator motor armature housing 22*c*, as seen in FIG. 5, freeing the actuator motor armature 22 for angular movement.

Figure 1:
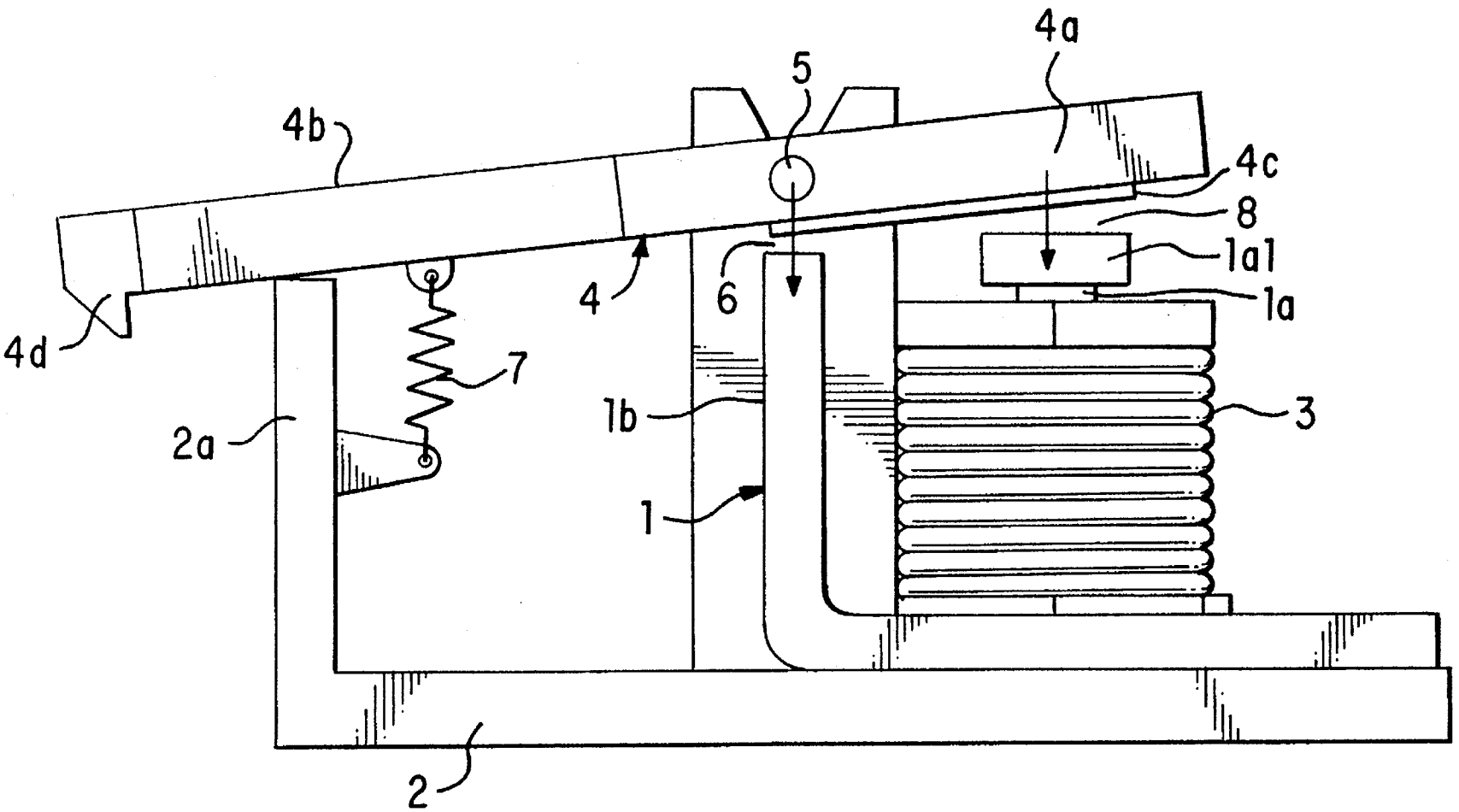
FIG. 1 PRIOR ART
FIG. 1, is an elevational view of an electromagnetic actuator representative of the prior art.

This electromagnetic actuator design, in reference to that of the prior art illustrated in FIG. 1, permits a larger angular displacement of the keeper 14*b* of the lever 14 while minimizing the variation in torque constant of the keeper 14*b* between its two extremes of angular movement. In designing an electromagnetic actuator a for an application in disk drives, such as that illustrated here, it is important that the design be compact and that power requirements for operation be minimal. As seen by inspection of FIGS. 4 and 5, the magnetic circuit design is such that there is a minimum of reluctance variation in the circuit as the keeper 14*b* moves between its two angular extremes. Also, the magnetically applied torque, when the coil 13 is energized to unlatch the actuator, has been increased with respect to that prior art arrangement seen in FIG. 1, by placing the pivot 15 in a position to the right of the yoke structure such that both of the air gaps 18 and 20 are positioned to the left of the pivot 15 at differing distances. Thus, with the keeper 14*b* in the latched position, when the coil 13 is energized, the flux coupling 5 at the proximal and distal gaps 18 and 20, produce torques acting in the same direction about the axis of the pivot 15. As the lever 14 and keeper 14*b* rotate counterclockwise, the force at the distal gap 20 decreases, see the arrow at the distal gap 20 in FIG. 3, and produces an opposing torque as the keeper 14*b* approaches and reaches its unlatched position. The electromagnetic actuator 9 functions as described because the magnetic circuit reluctance is low enough that this opposing torque due to the force at the distal gap is overwhelmed by the increased torque developed by the force of the magnetic coupling at the proximal gap 18 as that gap is reduced in size. In the unlatched position, the proximal gap t8 is eliminated when steel-to-steel contact takes place. In effect, with this design, the end face 14*f* of the keeper 14*b*, by being laterally displaced with respect to the side pole face 10*c* upon angular movement of the keeper 14*b*, bypasses the side pole face 10*c* of the yoke leg 10*b* adjacent its extremity, hence, the use of the term "bypassing pole face". With this arrangement, there is little change in the length of the distal gap 20 as the keeper 14*b* pivots about the axis of the pivot 15.

As the magnetic circuit is closed by counter-clockwise rotation of the keeper 14*b*, and the proximal gap 18 between the keeper 14*b* and the pole 10*al* closes, the reluctance of the magnetic circuit is significantly reduced, allowing a much smaller current to magnetically hold the keeper 14*b* in unlatched position.

This invention provides less variation in the torque constant $K_T$ for a given actuation angle of the keeper 14*b* than prior art designs, allowing for higher operation angles to be achieved.

While a specific structure has been disclosed which represents the presently known best mode for practicing this invention, variation in the design of the magnetic circuit to incorporate a variable dimension gap 18 and a substantially constant dimension low reluctance distal gap 20, will be readily apparent to those skilled in the art. By way of example, the keeper 14*b* may be lengthened. The lengthened keeper and/or the long pole leg may be offset laterally so that a side face of the keeper sweeps a side pole face of the long leg.

What is claimed is:

1. An electromagnetic device, comprising:

a. a yoke of magnetic material having a coil thereon, said yoke having a pair of legs which are spaced apart; and b. a lever;

c. pivot means pivotally mounting said lever for angular movement about an axis located outside of said yoke in a position removed from both legs of said pair of legs;

d. a keeper of magnetic material mounted to said lever to move angularly therewith;

e. said keeper having a first portion displaced from said axis defining a first gap with a first leg of said pair of legs, said first gap varying in gap dimension in the presence of angular movement of said keeper, and, said keeper having a second portion further displaced from said axis than said first portion defining a second gap with a second of said pair of legs, said second gap being substantially constant in gap dimension in the presence of angular movement of said keeper.

2. An electromagnetic device, comprising;

a. a yoke of magnetic material having a coil thereon, said yoke having a short leg and a long leg;

b. an angularly movable keeper having a first portion defining a variable gap with said short leg which varies in gap dimension in the presence of angular movement of said keeper, and, a second portion defining a gap with said long leg which remains substantially constant in gap dimension in the presence of angular movement of said keeper.

3. An electromagnetic device, comprising;

a. a yoke of magnetic material having a coil thereon, said yoke having a short leg and a long leg, said short leg having an end pole face and said long leg having a side pole face facing in the direction of said short leg, and b. an angularly movable keeper of magnetic material having a side face confronting said end pole face defining a first gap of variable gap dimension in the presence of angular movement of said keeper and having an end face confronting said side pole face defining a second gap, said second gap having a gap dimension which is substantially at right angles to the gap dimension of said first gap and of substantially constant dimension in the presence of angular movement of said keeper.

4. An electromagnetic actuator, comprising:

a. a yoke of magnetic material having a shod leg and a long leg, said shod leg having an end pole face and said long leg having a side pole face at the end of said long leg, said side pole face facing in the direction of said short leg;

b. a keeper of magnetic material having a side face at one end and an end face at the other end;

c. means pivotally supporting said keeper for angular movement between two angular positions in which, in a first angular position of said keeper, said side face of said keeper confronts said end pole face of said short leg and said end face of said keeper confronts and at least partially overlaps said side pole face of said long leg, and, in which angular movement of said keeper from said first angular position toward a second angular position of said two angular positions of said keeper, moves said side face of said keeper toward said end face of said short leg and moves said end face of said keeper laterally of said side pole face of said long leg to further overlap said side pole face of said long pole leg with said end face of said keeper;

d. a spring for biasing said keeper to said first, angular position, and e. a coil mounted to said yoke for producing magnetic flux in said yoke linking said keeper for magnetically biasing said keeper to said second angular position against the force of said spring.

5. An electromagnetic actuator, comprising:

a. a yoke of magnetic material, said yoke having a short leg and a long leg, each leg having an end portion thereof facing in the direction of said short leg and said shod leg having an end pole face at said end portion thereof;

b. a lever having a pole end and a functional end;

c. a keeper of magnetic material mounted to said pole end of said lever;

d. a pivot having an axis in a position displaced from said short leg outside of said yoke, said pivot engaging said lever between said pole end and said functional end for pivotally mounting said lever for angular movement about said axis, said keeper having a proximal end at a first distance from said pivot and a distal end at a second distance further removed from said pivot, said keeper having a side face adjacent said proximal end confronting said pole face of said short leg defining a proximal gap thereat and having an end face at said distal end confronting said side pole face of said long leg defining a distal gap thereat, said lever moving said keeper between a first angular position in which said proximal gap is maximum and a second angular position in which said proximal gap is minimal, said end face at said distal end of said of said keeper being laterally displaced of said side pole of said long leg between said first and said second angular positions of said keeper;

e. spring means for angularly biasing said lever and said keeper to said first angular position, and f. a coil on said yoke, said coil when energized producing magnetic flux in each leg of said yoke linking said keeper across said proximal gap and across said distal gap, the magnetic flux at each gap, at least when said keeper is in said first angular position, attracting and exerting commonly directed forces on said keeper at said gaps producing respective torques summed in said lever about said axis for initiating angular movement said keeper to said second angular position.

6. The electromagnetic actuator of claim 5, in said yoke is U-shaped.

7. The electromagnetic actuator of claim 5, in which;

a. said coil is on said short leg.

8. The electromagnetic actuator of claim 5, in which:

a. said pivot comprises a pivot shaft defining said axis.

9. The electromagnetic actuator of claim 5, in which:

a. said side face of said keeper at said proximal gap does not contact said end pole face of said short leg.

10. The electromagnetic actuator of claim 5, in which:

a. said spring means comprises a spring wire engaging said pivot shaft, one end of said spring wire being fixed and the other end engaging said lever, for spring biasing said lever and said keeper angularly about said pivot shaft to position said keeper in said second angular position in the absence of energization of said coil.

11. The electromagnetic actuator of claim 10, in which:

a. said engagement of said spring wire with said pivot shaft comprises at least a single turn of said spring wire about said pivot shaft.

12. The electromagnetic actuator of claim 5, in which:

a. said functional end of said lever has an operating attachment thereon having a portion radially displaced from said axis for performing a work function.

* * * * *